US008397164B2

(12) United States Patent
Hose et al.

(10) Patent No.: US 8,397,164 B2
(45) Date of Patent: Mar. 12, 2013

(54) APPARATUS AND METHOD FOR LOADING MEDIA IN A DIGITAL CINEMA SYSTEM

(75) Inventors: Jesse Hose, Carlsbad, CA (US); Carl Andrew Mueller, San Diego, CA (US); Vijaya Kumar Janjanam, San Diego, CA (US); Christopher Wingert, San Diego, CA (US)

(73) Assignee: Technicolor Digital Cinema LLC, Burbank, CA (US)

( * ) Notice: Subject to any disclaimer, the term of this patent is extended or adjusted under 35 U.S.C. 154(b) by 2761 days.

(21) Appl. No.: 09/798,368

(22) Filed: Mar. 2, 2001

(65) Prior Publication Data

US 2002/0122051 A1 Sep. 5, 2002

(51) Int. Cl.
*G06F 3/048* (2006.01)

(52) U.S. Cl. ..... 715/716; 715/748; 715/970.1

(58) Field of Classification Search ..... 345/716, 345/772, 708, 710, 963, 704, 723, 530, 730, 345/748, 724, 725, 835, 703; 707/205; 709/206; 715/716, 730, 748, 968, 970.1
See application file for complete search history.

(56) References Cited

U.S. PATENT DOCUMENTS 5,924,013 A * 7/1999 Guido et al. ..... 725/67
6,182,126 B1 * 1/2001 Nathan et al. ..... 709/219
6,384,893 B1 * 5/2002 Mercs et al. ..... 352/133
6,453,459 B1 * 9/2002 Brodersen et al. ..... 717/100
6,462,753 B1 * 10/2002 Koyata et al. ..... 345/716
2002/0089529 A1 * 7/2002 Robbin ..... 345/716

FOREIGN PATENT DOCUMENTS

WO WO 99/59335 * 11/1999

OTHER PUBLICATIONS

Rathbone, Andy. Dummies 101: Windows 95. 1996, IDG Books Worldwide, Inc. pp. 76-79.*

* cited by examiner

*Primary Examiner* — Namitha Pillai
(74) *Attorney, Agent, or Firm* — Robert D. Shedd; Robert B. Levy

(57) ABSTRACT

An apparatus and method for loading media in a digital cinema system is described. Specifically, the digital cinema system has a received storage medium and a local storage medium. A user is prompted to present the received storage medium. Responsive to the user specifying the received storage medium, a list of image programs is displayed. Responsive to the user specifying the image program, a list of audio programs is displayed. Responsive to the user specifying the audio program, how much storage space is required to store the selected image program and audio program on the local storage medium is determined. If the storage space required on the local storage medium is insufficient to load the selected image and audio programs, a warning indicative of insufficient storage space is displayed. Each selected program is then authenticated.

2 Claims, 8 Drawing Sheets

APPARATUS AND METHOD FOR LOADING MEDIA IN A DIGITAL CINEMA SYSTEM

BACKGROUND OF THE INVENTION

I. Field of the Invention

The present invention relates to digital cinema. More specifically, the present invention relates to an apparatus and method for loading media in a digital cinema system.

II. Description of the Related Art

In the traditional film industry, theatre operators receive reels of celluloid film from a studio or through a distributor for eventual presentation in a theatre auditorium. The reels of film include the feature program (a full-length motion picture) and a plurality of previews and other promotional material, often referred to as trailers. The theatre operator may also be required or choose to present some its own trailers, often comprising of local promotional and advertising material.

For presentation, a theatre operator builds a "platter", or playlist. This involves sequencing reels of celluloid film in the order in which it is to be presented, and physically splicing together the film to be played by the projector. In between trailers, or between a trailer and the feature, it is sometimes desirable to display a "black screen". A black screen is several seconds of blank film, which provides for a transition and somewhat of a dramatic affect between different trailers or features. To create a black screen, the theatre operator physically splices blank film into the desired areas in the same manner as trailers are put together.

A theatre operator also inserts cues and milestones onto celluloid film by physically attaching trigger strips onto the film. Cues may be attached in between programming, or within a particular feature or trailer. Currently, a theatre operator controls auditorium environment through the use of a theatre automation systems. Theatre automation systems control such functions as turning lights on and off, opening and closing curtains, and changing the projector lens. Theatre automation systems control these functions by reading a trigger strip physically placed onto the film as the film passes through a reader connected to the theatre automation system. Trigger strips are typically metallic or optical pieces of tape adhered onto the film. When the tape passes under the reader, an electrical signal is output to the theatre automation system. There are many theatre automation systems available and no uniform way in which theatre automation systems operate. That is, where a trigger strip is placed relative to a frame on the film will cause different theatre automation systems to behave differently. For example, a trigger strip may be placed on a left edge of the film, called an inboard cue, the center of the film, called a center cue, or the right edge of the film, called an outboard cue. Other theatre automation systems interpret only a single trigger strip regardless of where the trigger strip is placed relative to a frame on the film, or mandate in what position the strip must be placed (inboard, center, or outboard) in order to be read. Further still, other theatre automation systems attach meaning to combinations or sequences of trigger strips.

If a theatre operator wants to insert a cue during a presentation of a program, as studios sometimes mandate, the operator must physically look at the frames on the reel of film to determine where the cue should be inserted. Alternatively, the operator may estimate where a trigger strip should be placed by knowing that "x" number of feet of film is equal to about "y" seconds during presentation. For example, a "lights on" cue may be inserted ten seconds after the credits begin. The theatre operator would then physically attach the metallic or optical strip onto the proper place on the film by estimating how many feet of film translates into a ten second delay.

Trailers and features each have associated ratings, which define the appropriateness of the material for a given audience. In the U.S., ratings are labeled to motion pictures and trailers by the Motion Picture Association of America (MPAA). However, different jurisdictions have different ratings systems, and not all jurisdictions are consistent as to the rating level of a given program. Accordingly, a theatre operator in a given jurisdiction need be conscious of the types of programs he plans to display together.

Moreover, trailers and features are filmed using a specific display aspect ratio. The display aspect ratio refers to how the image was filmed and how the studio wants the image to be displayed. Typically, images are presented on projectors using either a scope lens or a flat lens. The cinema scope has a ratio of 2.35:1 and a flat lens has a ratio of 1:85:1. The ratio refers to the horizontal plane versus the vertical plane from the size the image is projected onto the screen. Further, various projectors are sensitive to the type of scanning or chroma sampling.

Along with reels of films comprising features and trailers, the theatre operator receives one or more soundtracks to be played with each film. Soundtracks come in a variety of languages and sound formats. Sound formats, such as stereo, 7.1, or 5.1, refer to the number of channels the sound format requires. Because sound systems vary greatly from theatre to theatre, the studio or distributor typically ship multiple soundtracks for a given film.

When a theatre operator is building a platter or playlist, the operator must be careful to ensure that the playlist is created accurately. For example, each image program should have the appropriate soundtrack loaded, in terms of language and sound format. Moreover, the image programs on the platter should have the appropriate ratings. That is, one wants to ensure that an "R" rated trailer is not displayed with a "G" rated movie. Further, cues must be inserted in the proper places and the correct lens needs to be attached to the projector in order for viewing at the proper display aspect ratio. However, human error is inevitable and all too frequent.

Further, an evolution of the film industry is occurring as the industry moves from celluloid film to digitized image and audio programs. Theatres are not equipped to process digital programming to load, create or monitor "digital platters."

SUMMARY OF THE INVENTION

With the advent of Digital Cinema systems, full-length motion pictures, trailers, advertisements and other audio/image "cinema-quality" programs are delivered to theatres throughout the world using digital technology. Digital Cinema systems deliver motion pictures that have been digitized, compressed and encrypted to theatres using either physical media distribution (such as DVD-ROM's) or electronic transmission methods, such as satellite.

Authorized theatres automatically receive the digitized programs and store them, typically while still encrypted and compressed. At each showing, the digitized information is retrieved via a local area network from the storage medium, then is decrypted, decompressed and displayed using cinema-quality electronic projectors featuring high quality digital sound.

Accordingly, an apparatus and method for loading media in a digital cinema system is described. Specifically, the digital cinema system has a received storage medium and a local storage medium. A user is prompted to present the received storage medium. Responsive to the user specifying the received storage medium, a list of image programs is displayed. Responsive to the user specifying the image program, a list of audio programs is displayed. Responsive to the user specifying the audio program, how much storage space is required to store the selected image program and audio program on the local storage medium is determined. If the storage space required on the local storage medium is insufficient to load the selected image and audio programs, a warning indicative of insufficient storage space is displayed. Each selected program is then authenticated.

Accordingly, it is an aspect of an embodiment to monitor the loading of one or more digital platters.

It is another aspect of an embodiment to provide for graceful recovery if errors occur during loading.

It is another aspect of an embodiment to authenticate each program.

It is another aspect of an embodiment to maintain a history of loading.

BRIEF DESCRIPTION OF THE DRAWINGS

The features, objects, and advantages of the invention will become more apparent from the detailed description set forth below when taken in conjunction with the drawings in which like reference characters identify correspondingly throughout and wherein.

DETAILED DESCRIPTION OF THE DRAWINGS

Figure 1:
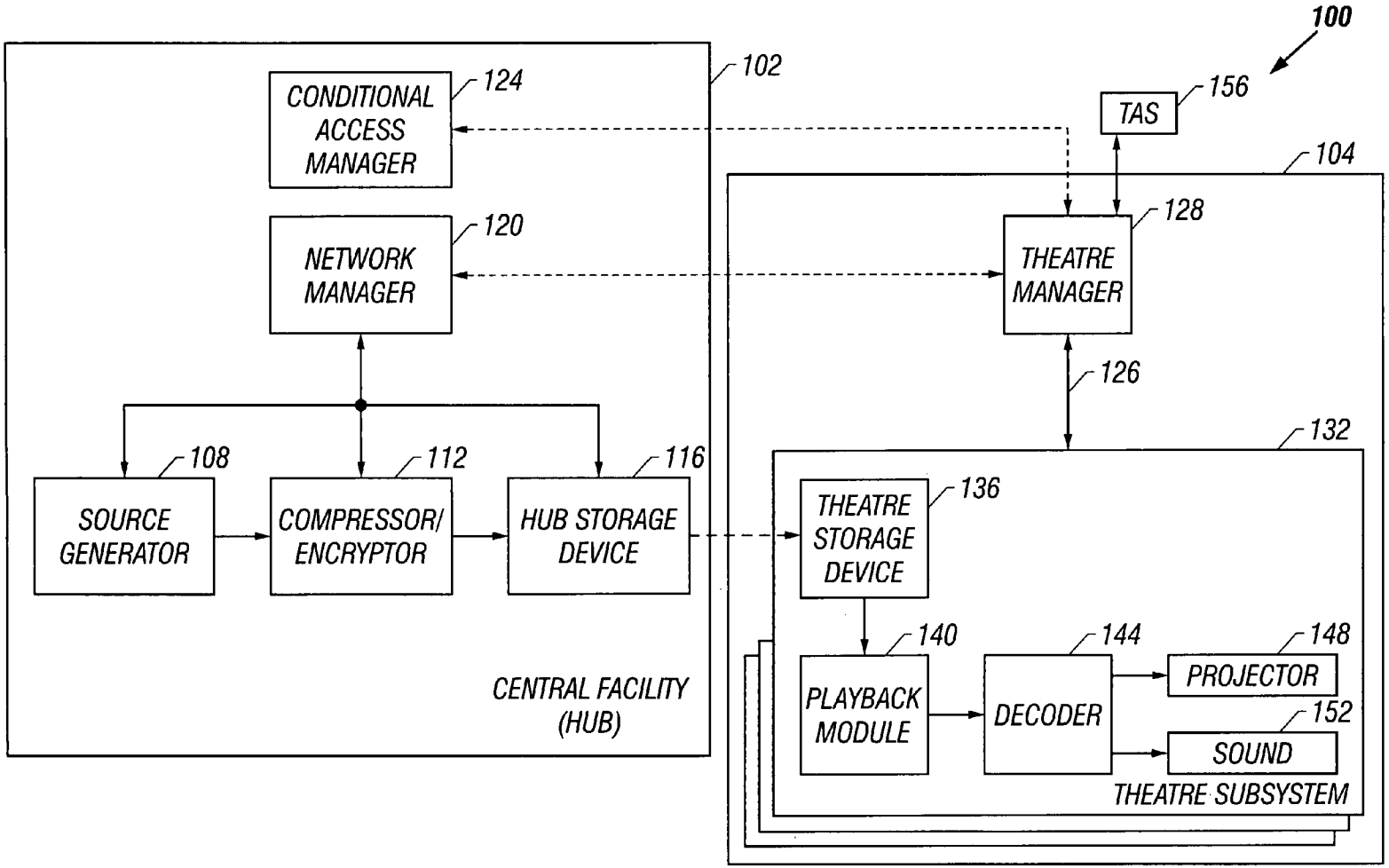
FIG. 1 illustrates a block diagram of a digital cinema system.

A digital cinema system 100 is illustrated in FIG. 1. The digital cinema system 100 comprises two main systems: at least one central facility or hub 102 and at least one presentation or theatre subsystem 104. The hub 102 and the theatre subsystem 104 are of a similar design to that of pending U.S. patent application Ser. No. 09/075,152 filed on May 8, 1998, entitled, "Apparatus and Method for Distribution of High Quality Image and Audio Programs to Remote Locations," and pending U.S. patent application Ser. No. 09/564,174, filed May 3, 2000, entitled, "Apparatus and Method for Encoding and Storage of Digital Image and Audio Signals," and pending U.S. patent application Ser. No. 09/563,880, filed May 3, 2000, entitled, "Apparatus and Method for Decoding Digital Image and Audio Signals," all assigned to the same assignee as the present invention, and are incorporated by reference herein.

In an embodiment, image and audio information are compressed and stored on a storage medium, and distributed from the hub 102 to the theatre subsystem 104. Generally, one theatre subsystem 104 is utilized for each theatre or presentation location in a network of presentation locations that is to receive image or audio information, and includes some centralized equipment as well as certain equipment employed for each presentation auditorium.

In the central hub 102, a source generator 108 receives film material and generates a digital version of the film. The digital information is compressed and encrypted by a compressor/encryptor (CE) 112, and stored on a storage medium by a hub, storage device 116. A network manager 120 monitors and sends control information to the source generator 108, the CE 112, and the hub storage device 116. A conditional access manager 124 provides specific electronic keying information such that only specific theaters are authorized to show specific programs.

In the theatre subsystem 104, a theatre manager 128 controls one or multiple auditorium subsystems 132. The theatre manager 128 controls loading, building a playlist, and controlling and monitoring presentation of image and audio information. The theatre manager may also maintain a history of image and audio programs presented. In an embodiment, each theatre manager may comprise of many auditorium managers, based on the number of auditoriums in a given theatre. In such cases, each auditorium manager controls loading, building a playlist, controlling and monitoring presentation, and maintaining a history of its respective auditorium. Each auditorium manager also interfaces with existing theatre automation systems (TAS) 156 for control of environmental functions.

Based on control information received from the theatre manager 128, a theatre storage device 136 transfers compressed information stored on the storage medium to a playback module 140. The playback module 140 receives the compressed information from the theatre storage device 136, and prepares the compressed information to a predetermined sequence, size and data rate. The playback module 140 outputs the compressed information to a decoder 144. The decoder 144 inputs compressed information from the playback module 140 and performs decryption, decompression and formatting, and outputs the image and audio information to a projector 148 and a sound module 152. The projector 148 plays the image information and the sound module 152 plays sound information on a sound system, both under control of the theatre manager 128.

Figure 2:
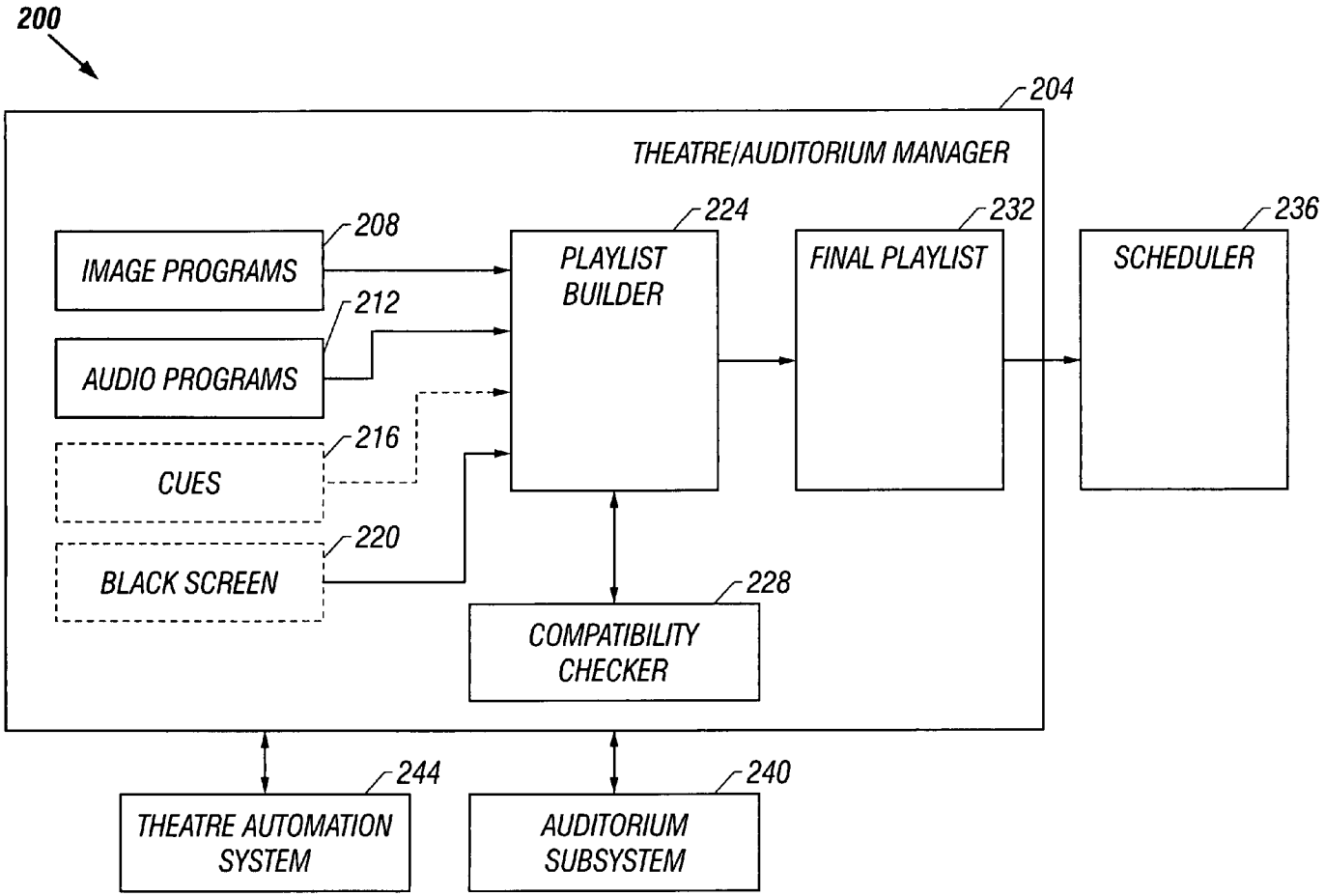
FIG. 2 illustrates a theatre manager and its associated interfaces.

FIG. 2 illustrates a block diagram 200 of the theatre or auditorium manager 204 and its interfaces. The auditorium manager 204 comprises of lists or databases of image programs 208 and audio programs 212. The auditorium manager may also comprise user definable or lists of cues 216 and black screens 220. A playlist builder 224 is configured to allow a user to build a playlist. The playlist builder 224 is configured to interface with a compatibility checker 228 to avoid mismatching. Upon successful compatibility, a final playlist 232 is created. The final playlist is configured to interface with a scheduler 236, which is configured to schedule final playlist 232 for presentation in a designated auditorium at a designated time. Upon playback through an auditorium subsystem 240, the auditorium manager 204 interfaces with an existing theatre automation system 244 as necessary for environmental control.

Media Management

In an embodiment, image and audio programs, such as movies, trailers and other program material, are shipped to the theatre on electronic, magnetic or optical transportable media. Cryptographic program keys may be shipped on separate media from the program data. Once at the theatre, the program material has to be loaded onto the auditorium manager of the auditorium(s) that will be presenting the program. When the program is no longer needed on a given auditorium manager, it needs to be removed to make room for new programs. The loading, removal, and transfer of programs may be accomplished using an auditorium manager feature called media manager.

For the nominal case, media required for a single presentation (e.g. snipes, trailers and feature presentation) are loaded onto a single hard drive. The hard drive is able to hold a predetermined amount of time of trailers and snipes and a full-length feature, with an audio program, of another predetermined amount of time. In an example, 20 minutes are reserved for trailers while 2.5 hours is reserved for the feature, at a nominal bit rate. For the case where the feature program is too large to fit on a single hard drive, the feature may be split across multiple hard drives, creating a compound drive.

Loading or removing a program to or from a hard drive that contains data required by the platter currently selected for playback is not allowed. This is to prevent access contention on the auditorium manager that could adversely impact the presentation. It is possible to load a program onto a decoder's auditorium manager while the decoder is in playback if the following conditions are met: all of the media necessary for the playback in progress is contained on a single hard drive, the program being loaded fits in its entirety on a single hard drive, and the hard drive on which the program being loaded is not the hard drive being used for the playback in progress.

Compound Drives

A compound drive is a pair of hard drives that have been logically linked together to allow for movies that are too large to fit on a single hard drive. A compound drive is made up of a primary drive and a secondary drive. The primary drive contains the platter(s), all of the trailers and snipes required by the platter(s) with their associated descriptor files, the feature movie's descriptor files, keys, and that part of the data of the feature movie that fits on the primary drive. The secondary drive contains the remaining part of the data of the feature movie that did not fit on the primary drive. Only one feature movie is allowed to span a compound drive at any time. The feature that spans the compound drive must be the sole feature on the primary drive. For example, a user is not allowed to load feature A, having a 2 hour duration, on a drive and then create a compound drive by loading another 2 hour movie, feature B, with the drive containing feature A as the primary drive.

A compound drive is created by linking the primary and secondary drives. media manager links drives by creating a compound disk profile on both the primary and secondary drives. The presence of a compound disk profile on a drive indicates that the drive is part of a compound drive. This profile contains the media id of the program that spans the drives, the creation time of the compound drive and an indication of whether the drive is the primary or secondary drive of the compound drive.

The media identifier and creation time are the same for both the primary and secondary disks, thus allowing the decoder to unambiguously determine that they are dealing with a compound drive and that they have the correct two drives that comprise the compound drive. This is especially important when doing media transfer of a compound drive.

Programs and other data (platters, etc) that pre-exist on the drive designated as the secondary drive are allowed to remain on the secondary drive as long as there is sufficient space on the drive for the movie being loaded. These pre-existing files on the secondary drive are visible via the media manager application and can be removed if desired, but they are not available for insertion into a platter. This is due to the restriction that all trailers, snipes, and features in a platter originate on the same drive as the platter. When the feature that spans the drives is removed from the auditorium manager, media manager unlinks the primary and secondary drives by removing the compound drive profile from both drives. Once the drives are unlinked the pre-existing files on the secondary drive are again available.

Media Loading

Before a program may be presented, the data and keys are loaded onto the decoder's auditorium manager. The following steps describe the process of loading a program:

1. User selects the "Load Media" feature from media manager application.

2. User selects the hard drive on which the media will be loaded.

3. Media manager checks that the hard drive onto which the media is to be loaded is not required by the currently selected platter. If the hard drive is required by the currently selected platter, media manager displays a message to the user indicating that the program cannot be loaded because the drive contains data needed by the currently selected platter and the loading process is aborted.

4. Media manager prompts user to insert the first disk of the set.

5. Media manager reads the installation meta data from the disk and displays a list of the available image programs on the disk. The user is then prompted to select which image program to load from the list of available image programs.

6. Media manager reads the installation meta data from the disk and displays a list audio programs available for the selected image program. Media manager prompts the user to select which audio programs to load from the list of available audio programs.

7. Once it is determined which audio program(s) to install, media manager reads the installation meta data from the first disk and determines how much storage space is required to load the entire program. Media manager then verifies that there is sufficient free space on the auditorium manager to load the program. Note that if the program being installed is a snipe or trailer, media manager is responsible for ensuring that loading the program will not cause the aggregate size of all snipes and trailers present on the hard drive to exceed the space allocated for these types of programs and thereby infringe on the space available to the feature presentation. If there is not sufficient free space on the auditorium manager, media manager displays a message to the user indicating that the program cannot be loaded onto a single drive and gives the user the option to create a compound drive.

8. Media manager loads the program and meta data files onto the auditorium manager, updating the load history as it goes. If more than one disk is required to transport the program, media manager prompts the user to insert the next disk(s) as needed to complete the load process.

9. When all of the programs and meta data files have been loaded onto the auditorium manager, media manager authenticates each program descriptor file using the signed hash contained in the descriptor file. If a descriptor file fails authentication, media manager displays a message to the user indicating the failure and allows the user to reload the file, suspend the load process or abort the load process. Authentication failures are recorded in a security log.

10. After the descriptor files have been authenticated, media manager checks the descriptor files to see if the program has been encrypted. If the program has not been encrypted the load session is complete. If the program has been encrypted media manager asks the user if they wish to load the keys now. If user responds affirmatively then media manager displays the interface for loading cryptographic keys.

Figure 3:
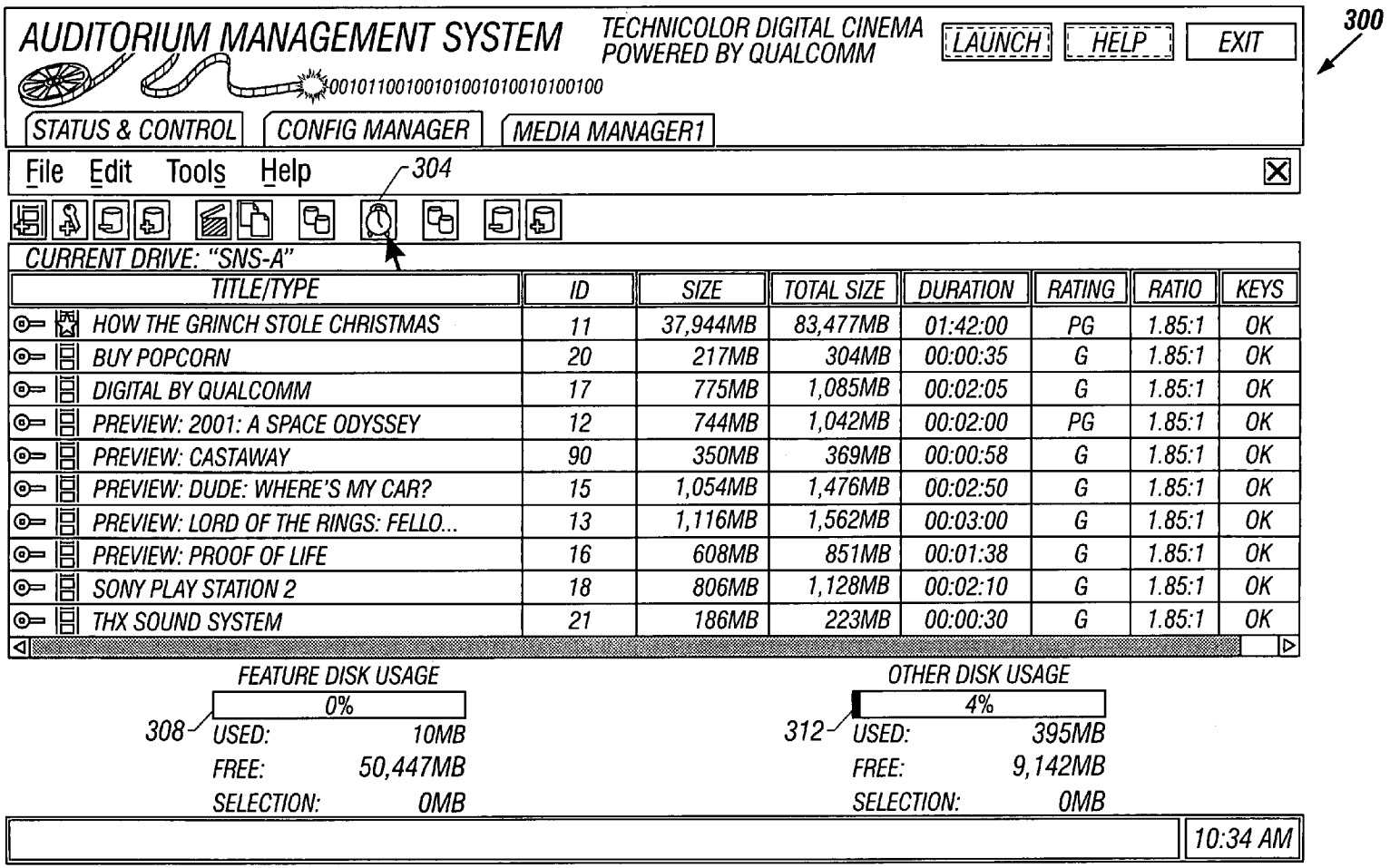
FIG. 3 illustrates a load image program window.

FIG. 3 illustrates a load image program window 300. A user can select the load image icon 304 to prompt a display of available image programs. A feature disk field 308 shows the capacity of a first segment of the local storage medium, and the amount of space available. Similarly, a other disk field 312 shows the capacity of a second segment of the local storage medium, and the amount of space available.

Figure 4:
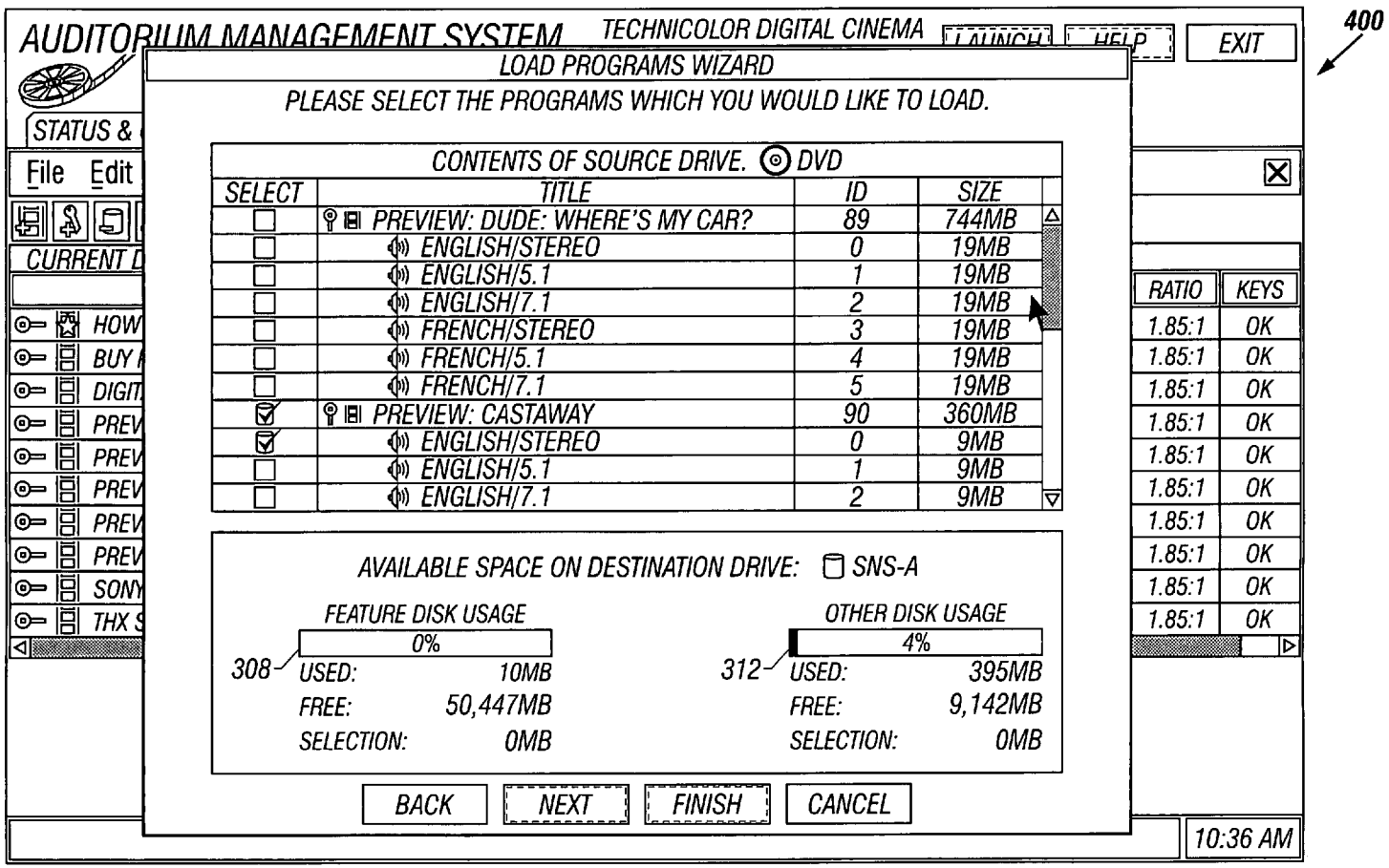
FIG. 4 illustrates a load audio program window.

FIG. 4 illustrates a load program window 400. The load program window 400 shows what programs are available for downloading from the received storage medium. Such information may be in meta data files accompanying the source material. The received storage medium is typically shipped to individual theatres, and is typically an optical or magnetic storage medium.

Figure 5:
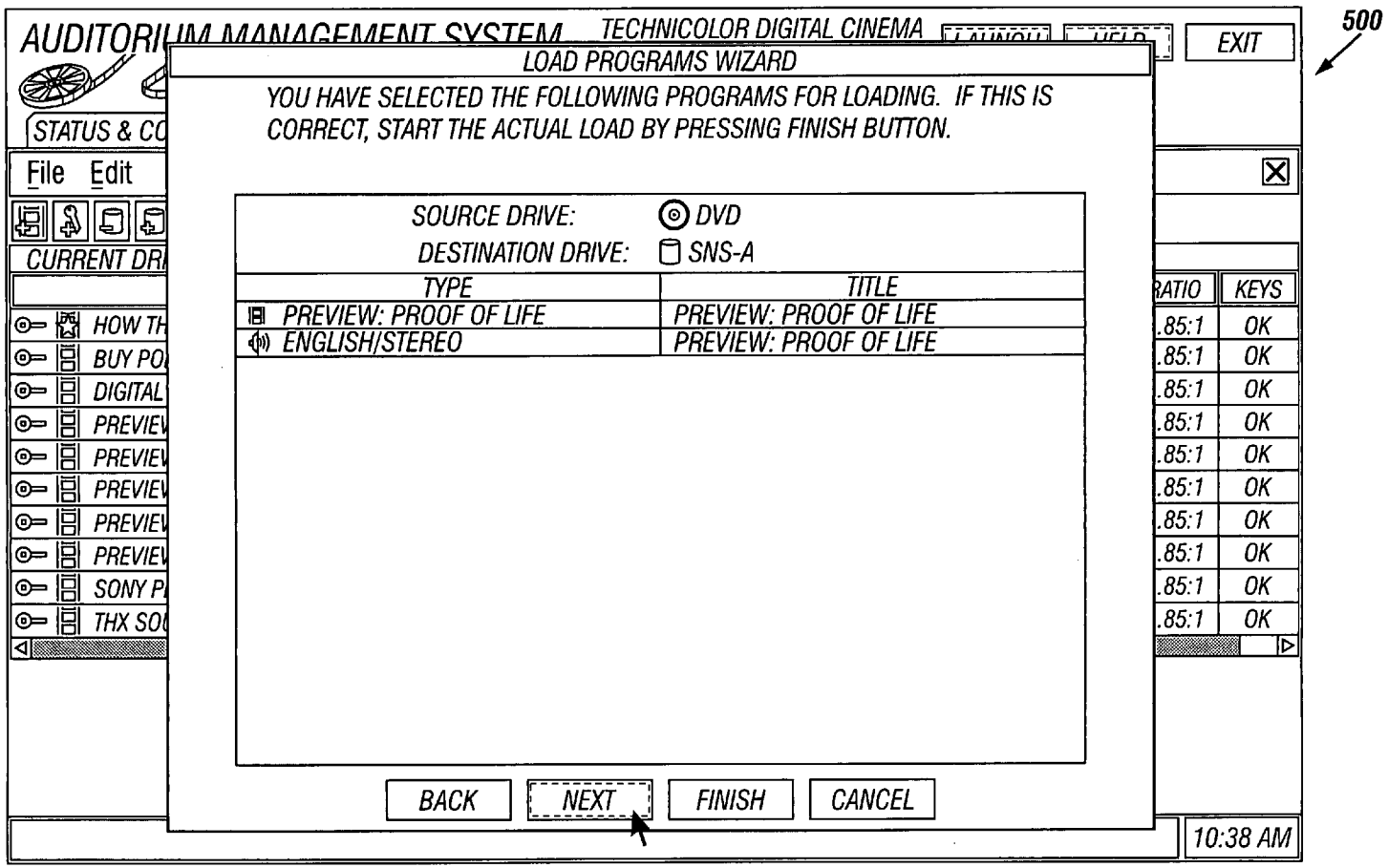
FIG. 5 illustrates a selected program window for loading.
Figure 6:
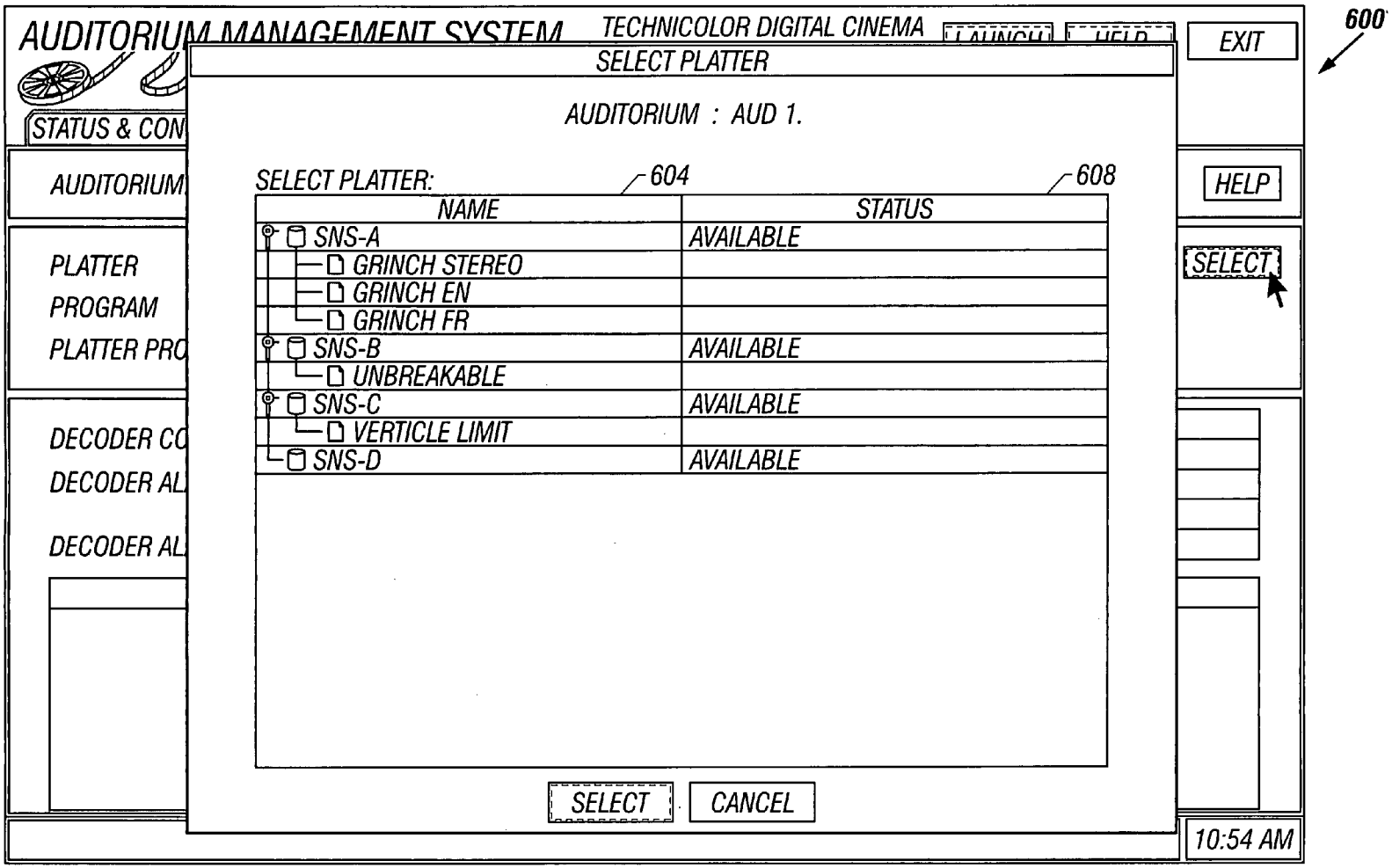
FIG. 6 illustrates a select platter window.

FIG. 5 illustrates a selected program window for loading 500. The loading window 500 is a confirmation screen before loading onto the local storage medium commences. FIG. 6 illustrates a select platter window 600. The window 600 comprises a name field 604, which lists programs stored on a given drive. A status field 608 indicates if the drive has remaining capacity, and if it is available for loading.

Figure 7:
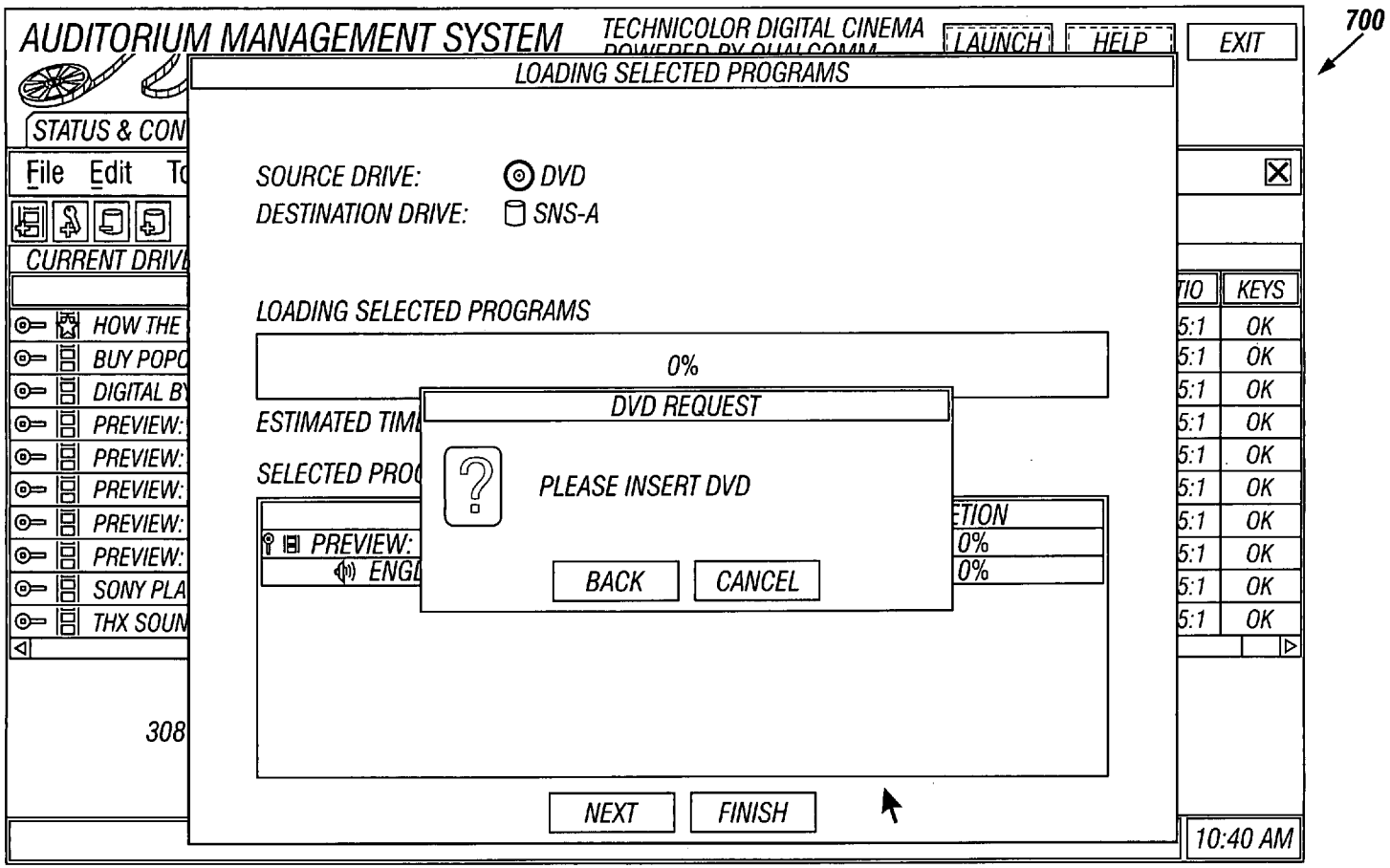
FIG. 7 illustrates a insert disk window.
Figure 8:
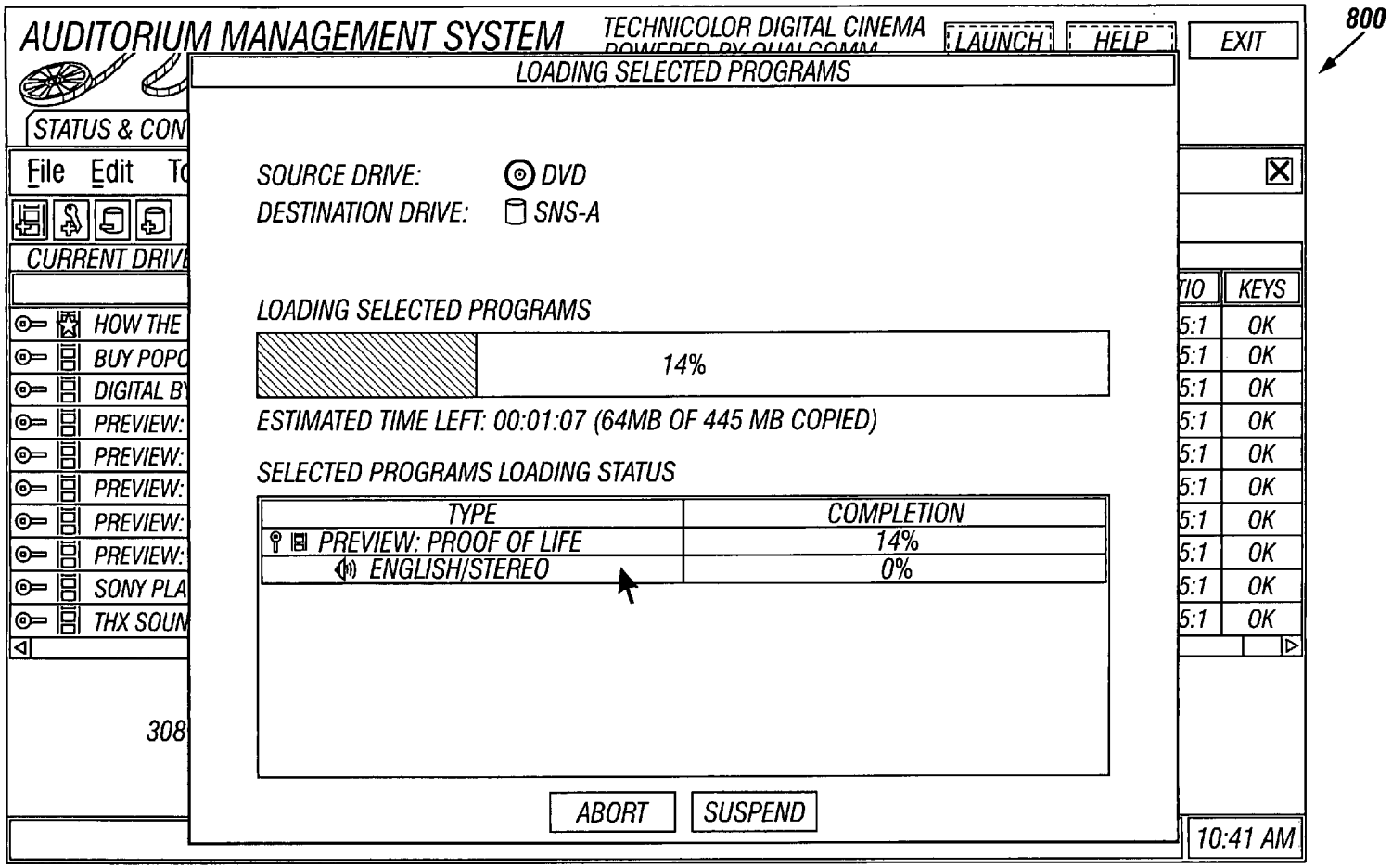
FIG. 8 illustrates a loading selected programs window.

FIG. 7 illustrates a insert disk window 700. The insert disk window 700 indicates to the user which disk contains the source material. FIG. 8 illustrates a loading selected programs window 800. The loading selected programs window illustrates status of pending downloads of programs.

In an embodiment, programs are subdivided into a number of smaller files, each file comprising of compressed data. Storage and transfer of manageable files facilitates graceful recovery if problems, such as loss of power, occur during loading. By subdividing into files, the point of last transfer of files can quickly be found, and reloading may commence.

Suspending the Loading Session

Media manager allows the user to suspend the loading session part way through and to be able to resume the session where it was stopped at a later date. Playback and media loading can occur simultaneously, but, generally, it is not allowed to select a platter that resides on a hard drive on which a load session is currently suspended.

Aborting the Loading Session

Media manager allows the user to abort the loading session at any time. Aborting the loading session causes media manager to stop loading the program files and delete from the auditorium manager all files that were copied to the auditorium manager during the aborted session.

Installation Meta Data

Media manager needs to know certain information in order to load a program. This information includes, but is not limited to, the program identifier, the program title, the storage space required for all of the program data and its associated meta data files, a list of all of the file names that comprise the program, the number of distribution disks required to transport the program and, on each transport disk, the sequence number of the disk and the program identifier. Some of this information, such as program title and storage requirement may be obtained from the program's descriptor files (Image and Audio). Other installation specific meta data such as disk sequence number, total number of disks, and list of files may require a separate 'installation meta data' file.

Media manager needs to create a 'load history' that resides on the hard drive that allows media manager to determine all of the files associated with an image program that have been loaded onto the hard drive(s). This 'load history' is used to determine what audio programs are available, and by media manager during media removal to ensure that all files associated with a program that have been loaded get removed.

Audio Updates

There may be multiple audio programs available for a given image program. During program loading the user is prompted to select which audio program(s) to load from a list of available audio programs. At some later point in time, the user may decide to load one of the audio programs not selected during the initial program load process (and in turn remove one of the already loaded audio programs to make room for the one to be loaded). Media manager allows a user to perform this activity. The user is prompted to insert the first disk of the transport media. Media manager displays a list of available audio programs. The user selects which audio program to load. Media manager verifies that there is enough disk space to load the program and then tells the user to insert the disk containing the audio program. Media manager loads the audio program onto the hard drive, prompting the user to insert the next disk if necessary. If the audio program has been encrypted, media manager determines if the audio program's key was loaded during the original load process and if not, prompt the user to insert the disk containing the key, loads the key and authenticates it. Finally, media manager updates the load history to reflect the changes made during an audio update process.

Cryptographic Key Loading

In an embodiment, keys may be distributed separately from the associated program data. Keys may be loaded onto the auditorium manager individually or as a set. A set of keys is defined to be all of the keys associated with a single image program (this includes the key for the image program and all of the keys that are available for the associated audio programs). Media manager encourages the user to load keys in complete sets because this simplifies key management for subsequent audio updates and for media transfer since all of the keys possibly needed for playback are available on the disk.

In order for a key to be loaded on the auditorium manager, its associated image program must be present on the auditorium manager. If the key being loaded is for an audio program, the audio program need not be present on the auditorium manager as long as the image program with which the audio program is associated is present on the auditorium manager.

The following steps describe the key loading process:

1. User inserts the transport media containing the keys into the appropriate disk drive and initiates the key loading process from media manager.

2. Media manager reads the key installation meta data from the disk and displays a description of available keys, with an indication of which of the keys can be loaded onto the auditorium manager (determined by the presence on the auditorium manager of the associated image program). User selects which keys are to be loaded, either individually or as a set.

3. Media manager loads the indicated keys, authenticating each key before loading it onto the auditorium manager. If a cryptographic key fails authentication, media manager records the authentication failure in the security log and displays a message to the user indicating the failure and allows the user to either skip loading the key that failed authentication and continue loading the next key or to abort the key loading session. Aborting a key loading session causes the session to end, leaving any successfully loaded keys on the auditorium manager. Key loading sessions cannot be suspended and later resumed.

4. Before loading the authenticated key onto the auditorium manager, media manager checks that the key is not already present on the auditorium manager. If media manager detects the presence of the key on the auditorium manager, the user is prompted to overwrite the existing key, skip loading the key and continue loading the remaining keys, overwrite all duplicate keys, or abort the key loading session.

5. As each key is successfully loaded onto the auditorium manager, media manager updates the load history to include the newly loaded key.

Media Loading with Compound Drives

A compound drive is created, or 'linked', by media manager when a user attempts to load a feature that is too large to fit in the space allocated for features. At the start of loading a program, the user indicates on which hard drive the program is to be loaded. When it is determined that a compound drive is required, the drive indicated at the start of the load session becomes the primary drive. The user is then prompted to select the secondary drive from a list of available drives. Once the secondary drive has been selected, media manager checks that there is sufficient space on the secondary drive to store the remaining data. If there is not enough available space on the drive selected to be the secondary drive, the user is prompted to choose another drive, if available, or abort the current load session, remove programs from the selected drive to make sufficient room to allow the drive to be used as the secondary drive, and then to re-start the load session.

Once the primary and secondary drives have been identified and verified to have sufficient space to load the feature, media manager links both drives as a parts of a compound drive by creating a compound drive profile on both the primary and secondary drives. Media manager then loads the program data onto the drive, filling up the primary drive and then placing the remaining data on the secondary drive. The cryptographic keys for the feature spanning the drives need to be loaded onto the primary drive, but are not loaded onto the auditorium manager until after the data has been loaded. Therefore, media manager must make sure to leave room on the primary drive for the cryptographic keys when loading the feature on the primary drive.

Authentication of Files

The theatre manager needs to authenticate certain files during media loading. Authentication requires possession of the hub's public signing key. The theatre manager gets the hub's public signing key from the Decoder rather than storing it explicitly on the theatre manager. The reason the theatre manager does not store the hub's public signing key is that in order to store the key, the theatre manager needs to be able to securely update the key as it changes over time. The process of updating the hub's public signing key requires possession of a digital cinema master verification key.

There can be two hub public signing key active at any one time. This means that if a file fails authentication with one key the theatre manager needs to try the authentication with the second key, if present, before determining that the authentication in fact failed. Both keys are available from the decoder.

Media Removal

Once a program is no longer needed on a decoder, it may be removed from the auditorium manager to make room for subsequent programs.

In addition to removing the files, media manager checks to see if the program to be removed is referenced as a program entry in any of the platters present on the auditorium manager. If media manager finds a reference to the program to be removed in a platter, the platter containing the reference is deleted. A program that is referenced in the currently selected platter cannot be removed. The following steps describe the process of removing a program:

1. User selects the "Remove Media" from the media manager application.

2. Media manager determines which hard drive(s) on the auditorium manager, if any, are required for the currently selected platter. If a given drive is not required for the currently selected platter, media manager displays a list of programs currently loaded on the drive. If a hard drive on the auditorium manager is required by the currently selected platter then media manager will not display the programs loaded on the drive but instead indicate that the required drive is not available for media management.

3. User selects a program from the list.

4. Media manager searches the platters present on the auditorium manager and displays a list of the platters that contain a reference to the program to be deleted. The user is informed that these platters will be deleted along with the program and asked to approve or decline the deletion of the platters. If the user declines the deletion of the listed platters media manager aborts the removal process. User can then edit the platters in platter Builder, removing the reference to the program to be deleted. Once the platter editing is finished, the user starts the media removal process from the beginning.

5. In an embodiment, if the program to be removed is an audio program, media manager removes all of the program data and associated meta data file. Media manager then updates the load history to reflect the removal of the audio program.

6. In another embodiment, if the program to be removed is an image program, media manager uses the information contained in the program's load history to remove all of the files associated with the selected program. This includes any and all associated audio, meta data, and platters that contain a reference to the deleted program. media manager is also responsible for removing the load history.

Media Removal with Compound Drives

Removing, or 'unlinking', a compound drive consists of removing the feature that spans the compound drive, and removing the compound disk profile from both the primary and secondary drives. This is done via media manager in the same fashion as removing any other movie. Media manager removes the feature's programs and unlinks the compound drive by removing the compound drive profile from both the primary and secondary drives. For simplicity's sake, once a compound drive is created, the compound drive remains in effect until the entire movie that spans the compound drive is removed. This is true even if removing a single, unused audio program would remove the necessity for the compound drive.

When a user attempts to remove program that spans a compound drive, media manager checks to see if both the primary and secondary drive are present in the auditorium manager. If only one drive of the compound drives is present in the auditorium manager, media manager displays a warning to the user that removing this program will cause the compound drive to be invalidated and the user must then confirm the deletion or cancel the operation. This behavior allows a user to unlink a disk used in a compound drive in the event that the other disk of the compound drive fails and is not available for media management.

Media Transfer

Media Transfer is the process of moving a presentation from one decoder to another without having to go through the entire load process. This is motivated by the need for theatres to quickly change movies from one auditorium to the next to accommodate consumer demand. This change often needs to be accomplished in the time allotted for the recessional (the time between the end of a presentation and the start of the next). This time constraint makes the task impossible to accomplish simply by re-loading the programs onto the desired decoder since the time it takes to load media is roughly equal to the duration of the presentation (i.e. hours as opposed to minutes). The transfer occurs at the granularity of a hard drive or compound drive, meaning all of the programs, snipes and trailers required for the platter are moved from one decoder to the other. Since the media required for a platter usually exists on a single drive, the transfer process involves moving drives (either logically or physically) from one decoder to the other. In the case where a feature is too large to fit onto a single drive, media transfer is accomplished by moving the two drives that comprise the complete platter.

Media manager typically does not allow the transfer process to be initiated while the decoder is in playback or while a platter is selected for playback. The theatre system does not support arbitrary transferring of media without going through the media manager application, thus the theatre manager must be operational during media transfer.

The success or failure of transferring one hard drive of an auditorium manager should not affect the ability to playback a platter from the auditorium manager drive that is not being transferred. If the transfer process fails or is interrupted, the theatre system still has the capability to be brought online and present a platter from the existing drive.

The process of transferring media for the situation where the hard drive is physically removed from one decoder's auditorium manager and inserted into another decoder's auditorium manager is two step process comprising removing the drives from the source auditorium manager and inserting the drives into the destination auditorium manager.

Removing a Drive From the Auditorium Manager

The procedure for removing a drive from the auditorium manager is as follows:

1. User selects 'Remove Drive' from the media manager application.

2. Media manager verifies that the decoder is not in playback. If media manger determines that the decoder is in playback, media manger outputs a message indicating that drive removal cannot take place during playback and the removal process is aborted.

3. Media manager verifies that the hard drive to be removed from the auditorium manager does not contain media required by the platter selected for playback. If hard drive to be removed contains media required by the platter is selected, media manager displays a message to that effect and allows the user to either abort the removal process or have media manager de-select the platter.

4. Media manager determines if the drives in the auditorium manager are a compound drive. In the event that the media is being transferred on a compound drive, media manager displays a message informing the user that both hard drives must be transferred and waits for the user to acknowledge the message before proceeding.

5. Media manager instructs decoder to go to an offline state (logically disconnected from the auditorium manager, e.g. the decoder is not mounted on any of the auditorium manager drives). Media manager waits for a message from the decoder indicating the decoder is offline.

6. Media manager causes all files residing on the auditorium manager that are currently in use by the theatre manager to be closed. Once the files are closed, media manager unmounts all auditorium manager drives currently mounted by the theatre manager.

7. Media manager performs whatever actions are necessary bring the auditorium manager to a state that enables disk removal.

8. Media manager displays a message indicating that it is now safe to remove the hard drive(s) and to click the 'OK' button after removing the hard drive(s).

Inserting a Drive into the Auditorium Manager

The procedure for inserting a drive into the auditorium manager is as follows:

1. User selects 'Insert Drive' from media manager application.

2. Media manager verifies that the decoder is not in playback. If media manger determines that the decoder is in playback, media manger outputs a message indicating that drive insertion cannot take place during playback and the insertion process is aborted.

3. Media manager checks that the decoder is in an offline state. If the decoder is not in an offline state, media manager instructs decoder to go to an offline state (logically disconnected from the auditorium manager, e.g. the decoder is not mounted on any of the auditorium manager drives). Media manager waits for a message from the decoder indicating the decoder is offline.

4. Media manager causes all files residing on the auditorium manager that are currently in use by the theatre manager to be closed. Once the files are closed, media manager unmounts all auditorium manager drives currently mounted by the theatre manager.

5. Media manager performs whatever actions are necessary bring the auditorium manager to a state that enables disk insertion.

6. Media manager displays a message indicating that it is now safe to insert the hard drive(s) and to click the 'OK' button after inserting the hard drive(s).

7. Media manager then attempts to mount the drives. If, after allowing sufficient time for the loop initialization protocol to complete, the drive(s) cannot be mounted media manager displays a message indicating the error.

8. Media manager performs some verifications on the drives to a) check that the drives are valid Digital Cinema formatted drives and b) if the media inserted spans two drives that both drives of the compound drive are present. If any of the verifications fail media manager outputs a message indicating the nature of the failure.

9. Media manager notifies decoder that the drives are now available and waits for a response from the decoder.

10. For each encrypted program on the transferred drive(s), media manager checks for the presence of a cryptographic program key for the decoder to which the media has been transferred. If media manager cannot find the key for a given program, media manager outputs a message indicating the program that is missing the key. The user is then prompted to load the key.

11. Once the disk insertion is complete, the final step in transferring media is selecting the desired platter for presentation. Media manager displays a message informing user that the transfer is complete and a reminder that a platter must be selected before playback can occur.

Transferring Media While Decoder is Down

The procedures defined for removing and inserting drives from the auditorium manager assume that the decoder is up and running properly. There may be times when the user needs to transfer media because decoder is down or malfunctioning. In these cases, the user initiates the drive removal and insertion process in the same manner as if the decoder was functioning normally. The theatre manager will detect that the decoder is not responding and display a message to the user stating that the decoder is not responding and allow the user to abort or continue the selected procedure. If the user chooses to continue, media manager instructs the user that the user must make sure that the decoder is powered down before continuing otherwise data on the auditorium manager could get lost or corrupted. Media manager then waits for the user to select 'Continue'. The reason we want the decoder powered down is that we need to make sure the decoder is not trying to access the auditorium manager when we remove or insert the drives to avoid any possibility of data corruption. Since the theatre manager must assume that it cannot communicate with a decoder that is not responding, it cannot tell it to go offline and the only way to ensure that the decoder is offline in this circumstance is to shut it down. When the user selects 'Continue', indicating that the decoder is powered down, the theatre manager continues with the selected procedure, skipping any step that requires communication with the decoder.

Power Outage Recovery

All media management performed by a theatre user on the theatre manager is done through media manager. A power outage that occurs while performing media loading or removal can leave the auditorium manager in an inconsistent state with the possibility incomplete files or programs on the auditorium manager. The theatre user does not have operating system level access to the auditorium manager required to be able to return the auditorium manager to a consistent state, therefore media manager needs to be able to recover from power outages that occur during the loading and removing of media.

For media loading, power outage recovery consists of the theatre manager being able to detect upon power up that a load session was in progress and be able to pick up loading at some point close to where it was interrupted, most likely at the granularity of a file. If an incomplete file resides on the auditorium manager due to the power outage, the theatre manager may need to remove the file from the auditorium manager and start the load process from the beginning of the file. When, upon power up, the theatre manager detects an interrupted load session, the theatre manager displays a message to the user that an interrupted load session was detected and the user has the option to continue, suspend, or abort the load session. If the user chooses to continue the load session, the theatre manager prompts the user to insert the proper disk in order to continue.

For media removal, power outage recovery consists of the theatre manager being able to detect upon power up that media removal was in progress and be able to pick up the removal at the point where the power outage occurred, or at the most recent point in the removal process where it is possible to restart the process.

Transferring media does not cause a modification of files on the auditorium manager therefore no explicit recovery is required if a power outage occurs during media transfer. If a power outage occurs before the media transfer operation has completed, the operation must be started over from the beginning upon power up.

Features in Media Loading

In an embodiment, media manager does not allow loading a program onto a hard drive on the decoder's auditorium manager while that hard drive is required for presentation of the selected platter. In another embodiment, media manager is able to load a program while a presentation is in progress as long as the hard drive onto which the program is being loaded is not required for the presentation of the platter being presented (i.e. the selected platter). In another embodiment, media manager allows a user to select which image program is to be loaded onto the auditorium manager. This is to allow for the possibility of multiple movies and/or trailers being distributed on the same set of distribution media.

In another embodiment, media manager allows a user to select which audio programs are to be loaded with the selected image program. This is to allow for multiple audio programs being distributed for a single image program. In another embodiment, media manager allows to load additional audio programs associated with an image program that was loaded onto the auditorium manager during a prior load session. In another embodiment, media manager does not allow a user to load an audio program if its associated image program is not already present on the auditorium manager to which the audio program is being loaded, except when it is being loaded in the same load session as its associated image program.

When loading an audio program associated with an image program loaded in a prior load session, media manager shall check for the existence of the audio program's cryptographic key on the auditorium manager, displaying an informational message to the user if the key is not present.

When loading a program, media manager provides prompts to the user to guide the user through the loading process. Before loading a program onto a decoder's auditorium manager, media manager verifies that there is sufficient free space on the auditorium manager to allow loading the entire set of program data, meta data and cryptographic key files that comprise the program. In the case that the program being loaded is a trailer or a snipe, media manager verifies that loading the program shall not cause the aggregate file size of all trailers and snipes on the hard drive to exceed the memory allocated for such programs. The amount of memory on the hard drive allocated for trailers and snipes shall be sufficient to store 20 minutes of presentations at the nominal bit rate.

If media manager determines that there is not sufficient free space on the decoder's auditorium manager to load the entire set of files that comprise the program being loaded, media manager displays a message indicating to the user that the program cannot be loaded because there is insufficient free space on the auditorium manager and the user is given the option to create a compound drive.

Media manager uses the decoder as the repository for its cryptographic verification keys, getting the keys from the decoder as needed for media verification and authentication. When the decoder has two simultaneously active hub verification keys, media manager attempts to authenticate media with both keys prior to determining the authentication to have failed. In another embodiment, media manager authenticates media descriptor files associated with a program being loaded onto a decoder's auditorium manager. If a descriptor file fails authentication, media manager displays a message to the user indicating the authentication failure and allow the user to either reload the file, suspend, or abort the loading session.

In another embodiment, media manager authenticates cryptographic key files prior to loading them onto the auditorium manager. If a cryptographic key file fails authentication, media manager displays a message to the user indicating the authentication failure and allow the user to either reload the file, suspend, or abort the loading session. In another embodiment, media manager allows a user to load cryptographic keys as a separate process from loading program data. Media manager also allows a user to load all of the keys associated with an image program as a set. This includes the key for the image program and any available keys for the associated audio programs.

Media manager allows a user to load a single key from a list of keys present on the key distribution media. In another embodiment, media manager does not allow a cryptographic key to be loaded onto an auditorium manager if the associated image program is not present on that auditorium manager. If a user attempts to re-load a cryptographic key that is already present on the auditorium manager, media manager requires the user to confirm the re-load prior to overwriting the existing key.

Media manager allows a user to suspend a load session. Also, media manager allow a user to resume a load session that has been suspended, resuming at the point that the session was suspended. The decoder is able to start the presentation of a previously loaded program in the presence of a suspended load session, as long as the hard drive(s) associated with the suspended session do not contain data required for the presentation.

Media manager does not allow more than one load session to be in progress at any time. A load session must complete or be aborted before the next load session can be started.

media manager shall allow the user to abort a load session.

When a user aborts a load session, media manager ceases loading the program files and removes from the auditorium manager all files that were copied to the auditorium manager during the aborted session.

Media manager generates a load history from which media manager can determine which files have been loaded on the auditorium manager. Media manager keeps the load history current as it loads and removes media from the auditorium manager.

When loading a feature (or trailer) on a hard drive, media manager leaves sufficient space on the drive (the primary drive for a compound drive) to load the complete set of the programs cryptographic keys.

Media Removal

Media manager does not allow removal of any program from a hard drive, if the hard drive is required by the currently selected platter. If a user attempts to remove a program from a hard drive that is required by the currently selected platter, media manger displays a message indicating to the user that the program cannot be removed, stating the reason why.

When a user attempts to remove a program that is part of a feature that spans a compound drive, media manager verifies that both the primary and secondary drives of the compound drive are present in the auditorium manager. When a user attempts to remove a program that is part of a feature that spans a compound drive and media manager determines that only one of the drives of a compound drive is present in the auditorium manager, media manager displays a message indicating that removing this program will cause the compound drive to be invalidated and require the user to confirm or cancel the delete operation.

Removing a program associated with a feature that spans a compound drive, with only one drive of the compound drive present in the auditorium manager, causes the removal of the compound drive profile and all of the programs associated with the feature that spans the compound drive that are present on the drive, thereby unlinking the compound drive. Unlinking a compound drive comprises of removing all of the programs, cryptographic keys, and meta data associated with the movie that spans the compound drive and removing the compound disk profile from both the primary and secondary drives. When both drives of a compound drive are present in the auditorium manager, media manager unlinks the compound drive only when removing the image program associated with the movie that spans the compound drive. Media manager removes all platters that contain a reference to the program to be deleted.

Prior to removing platters that contain a reference to the program to be deleted, media manager displays a message listing the platters it intends to delete and require the user to either confirm the deletion or abort the removal process. When removing an image program, media manager removes from the auditorium manager all of the files that were loaded on the auditorium manager during the program's load session. When removing an audio program and not its associated image program, media manager removes only the audio program and the associated audio meta data files. When removing a program, media manager updates the load history to reflect that the removed program is not present on the auditorium manager.

Media Transfer

Media manager provides an interface that walks the user through the process of inserting or removing a hard drive from an auditorium manager. Media manager verifies that the decoder is not in the middle of playback before allowing insertion or removal of a hard drive to occur. If the decoder is in the middle of playback when a user attempts to insert or remove a hard drive via media manager, media manager displays a message stating that insertion/removal process cannot occur when the decoder is in playback and abort the process. Media manager verifies that the hard drive to be removed from the auditorium manager does not contain media required by the platter selected for playback before allowing the removal to occur.

If media manager determines that the hard drive to be removed from the auditorium manager contains media required by the platter selected for playback, media manager displays a message to that effect and allow the user to abort the drive removal process or have media manager de-select the platter.

Media manager determines if the drive to be removed from the auditorium manager is part of a compound drive. If media manager determines that the drive to be removed from the auditorium manager is part of a compound drive, media manager displays an informational message stating the media being transferred spans two drives and that both disks must be removed. This displayed message requires a user confirmation before media manager proceeds with the removal process.

To prevent data loss or corruption and to keep theatre manager software in a consistent state when inserting or removing drives from the auditorium manager, media manager causes open auditorium manager files to be closed by notifying the other theatre manager applications so they may close their open files and by closing open auditorium manager files in use by media manager.

To prevent data loss or corruption and to keep theatre manager software in a consistent state when inserting or removing drives from the auditorium manager, once all auditorium manager files in use by the theatre manager have been closed, media manager unmounts the auditorium manager drives.

When removing a hard drive, media manager instructs the decoder to go offline so that it may do whatever clean up it needs to prevent data loss or corruption when the hard drive is removed. After instructing the decoder to go offline, media manager waits for a response from the decoder confirming that it is offline before allowing disk insertion or removal to occur.

Prior to hard drive insertion or removal, media manager causes the auditorium manager to perform whatever actions are necessary bring the auditorium manager to a state that allows disk insertion and removal. Prior to hard drive insertion or removal and before unmounting the auditorium manager drives, media manager causes all files residing on the auditorium manager that are currently in use by the theatre manager to be closed.

Prior to hard drive insertion or removal, media manager unmounts all auditorium manager drives currently mounted by the theatre manager. Once the auditorium manager, theatre manager, and decoder are ready for drive removal, media manager displays a message letting the user know that it is OK to remove the drive(s).

When a user initiates the hard drive insertion process, media manager shall verily that the decoder is not in playback. If media manger determines that the decoder is in playback when a user initiates the hard drive insertion process, media manger outputs a message indicating that drive insertion cannot take place during playback and the insertion process is aborted. During the hard drive insertion process, after verifying that the decoder is not in playback, media manager instructs the decoder to go to an offline state.

Once the auditorium manager, theatre manager, and decoder are ready for drive insertion, media manager displays a message letting the user know that it is OK to insert the drive(s) and wait for the user to indicate that the drive(s) has been inserted. After user has indicated that the drive(s) has been inserted into the auditorium manager and after allowing sufficient time for the loop initialization protocol to complete, media manager shall attempt to mount the drives in the auditorium manager, displaying an error message in the event the mount failed.

When a hard drive(s) is inserted into the auditorium manager, media manager verifies that the inserted drive(s) is a valid formatted Digital Cinema drive. When a hard drive(s) is inserted into the auditorium manager, media manager determines if the transferred media spans a compound drive.

If media manager determines that the transferred media spans a compound drive, media manager verifies that both drives of the compound drive exist in the auditorium manager. If media manager determines that the auditorium manager does not contain the matching pair of drives for transferred media that spans a compound drive, media manager prepares the decoder, theatre manager, and auditorium manager for drive removal and display a message that the auditorium manager contains the incorrect drives and prompt the user to insert the correct drive(s).

When media manager has verified that the inserted drives are valid (formatted and a matching pair of drives for media spanning two drives), media manager notifies the decoder that the auditorium manager is now available for use and wait for a response from the decoder. When the disk insertion process has completed successfully, media manager displays a message indicating successful completion.

After the disk insertion process has completed successfully, for each encrypted program, media manager checks for the existence of the associated cryptographic key for the decoder to which the media has been transferred, outputting a message indicating that all keys are present, or a list of missing keys to prompt the user to load the required keys.

If the decoder does not respond to the theatre manager during insertion or removal of a hard drive, the theatre manager notifies the user that the decoder is not responding and allow the user to continue or abort the insertion/removal process.

If the user chooses to continue insertion or removal process when informed that the decoder is not responding to the theatre manager, the theatre manager issues a message instructing the user to make sure that the decoder is powered down, wait for the user to signal to continue and then continue the insertion or removal process, performing all of the steps that do not require communication with the decoder.

To allow for possible media transfer failures or interruptions, the theatre system is able to present a platter with only one drive in the auditorium manager, provided the drive contains all of the necessary media required by the platter being presented.

Media Management Power Outage Recovery Requirements

If a power outage occurs while a media load session is in progress, the theatre manager, upon power up, is able to detect the incomplete load session. If an incomplete load session is detected by the theatre manager upon power up, the theatre manager, using media manager, notifies the user of the incomplete load session and allows the user to continue, suspend or abort the load session. If the user chooses to continue an incomplete load session, media manager indicates to the user which disk of the transport media to insert in the disk drive and guide the user to completion of the load session. If the user chooses to suspend an incomplete load session, media manager performs any operations necessary (e.g. removing an incompletely loaded file) to bring the load session into a state from which it can be suspended and then suspend the load session.

If the user chooses to abort an incomplete load session, media manager aborts the session in accordance with the requirements for aborting a load session. If a power outage occurs while media removal is in progress, the theatre manager, upon power up, is able to detect the incomplete media removal session.

If an incomplete load session is detected by the theatre manager upon power up the theatre manager, via media manager, continues the removal at the point where the power outage occurred, or at the most recent point in the removal process where it is possible to restart the removal process.

As used herein, image programs comprise encoded image information, and may comprise a number of image files. Similarly, audio programs comprise encoded audio information, and soundtracks and may comprise a number of audio files. Accordingly, it is recognized that image programs and audio programs may be combined or subdivided into groups of encoded data in any number of manageable image files and audio files.

As examples, the various illustrative logical blocks, flowcharts, windows, and steps described in connection with the embodiments disclosed herein may be implemented or performed in hardware or software with an application-specific integrated circuit (ASIC), a programmable logic device, discrete gate or transistor logic, discrete hardware components, such as, e.g., registers and FIFO, a processor executing a set of firmware instructions, any conventional programmable software and a processor, or any combination thereof. The processor may advantageously be a microprocessor, but in the alternative, the processor may be any conventional processor, controller, microcontroller, or state machine. The software could reside in RAM memory, flash memory, ROM memory, registers, hard disk, a removable disk, a CD-ROM, a DVD-ROM or any other form of storage medium known in the art.

The previous description of the preferred embodiments is provided to enable any person skilled in the art to make or use the present invention. The various modifications to these embodiments will be ready apparent to those skilled in the art, and the generic principles to find herein may be applied to other embodiments without the use of inventive faculty. Thus, the present invention is not intended to be limited to the embodiments shown herein but is to be accorded the widest scope consistent with the principles and novel features disclosed herein.

What is claimed is:

1. In a digital cinema system, the system having a received storage medium and a local storage medium, a method for loading media, the method comprising:

prompting a user to present the received storage medium;

responsive to the user specifying the received storage medium, displaying a list of image programs;

responsive to the user specifying the image program, displaying a list of audio programs;

responsive to the user specifying the audio program, determining how much storage space is required to store the selected image program and audio program on the local storage medium;

displaying a feature disk field showing a capacity of a first segment of the specified local storage medium designated for a feature and an other disk field showing a capacity of a second segment of the specified local storage medium designated for non-feature related images and audio;

if the storage space required on the local storage medium is insufficient to load the selected image and audio programs, displaying a warning indicative of insufficient storage space; and authenticating each selected program.

2. In a digital cinema system, the system having a received storage medium and a local storage medium, a method for loading media, the method comprising:

means for prompting a user to present the received storage medium;

means for responsive to the user specifying the received storage medium, displaying a list of image programs;

responsive to the user specifying the image program, means for displaying a list of audio programs;

responsive to the user specifying the audio program, means for determining how much storage space is required to store the selected image program and audio program on the local storage medium;

displaying a feature disk field showing a capacity of a first segment of the specified local storage medium designated for a feature and an other disk field showing a capacity of a second segment of the specified local storage medium designated for non-feature related images and audio;

if the storage space required on the local storage medium is insufficient to load the selected image and audio programs, means for displaying a warning indicative of insufficient storage space; and means for authenticating each selected program.

* * * * *